US006125839A

United States Patent [19]

Elgowainy et al.

[11] Patent Number: 6,125,839

[45] Date of Patent: Oct. 3, 2000

[54] COMBUSTION AIR INTAKE APPARATUS FOR FUEL-FIRED, DIRECT VENT HEATING APPLIANCE

[75] Inventors: Amgad A. Elgowainy, Justice, Ill.; John H. Scanlon, Montgomery, Ala.

[73] Assignee: Rheem Manufacturing Company, New York, N.Y.

[21] Appl. No.: 09/439,726

[22] Filed: Nov. 12, 1999

[51] Int. Cl.[7] ..... F24C 3/00

[52] U.S. Cl. ..... 126/85 B; 454/10

[58] Field of Search ..... 122/13.01; 454/10; 126/85 B

[56] References Cited

U.S. PATENT DOCUMENTS

| | | | |
|---|---|---|---|
| 5,182 | 7/1847 | Emerson . | |
| 458,179 | 8/1891 | Lovejoy | 454/10 |
| 983,179 | 1/1911 | Swift . | |
| 2,398,322 | 4/1946 | Neumann | 181/42 |
| 2,766,677 | 10/1956 | Silverman | 98/62 |
| 2,942,683 | 6/1960 | Moyer | 181/42 |
| 2,966,838 | 1/1961 | Thompson et al. | 98/62 |
| 3,056,397 | 10/1962 | Little | 126/85 B |
| 3,382,860 | 5/1968 | Cooper et al. | 126/85 |
| 3,435,816 | 4/1969 | De Werth | 126/85 |
| 3,477,358 | 11/1969 | Howard | 454/10 |
| 3,765,823 | 10/1973 | Kawabata et al. | 431/157 |
| 3,874,363 | 4/1975 | Biedenbender et al. | 126/85 B |
| 3,994,280 | 11/1976 | Winters et al. | 126/307 |
| 4,018,381 | 4/1977 | Bisegna | 126/85 B |
| 4,161,941 | 7/1979 | Bloxham | 126/85 B |
| 5,062,354 | 11/1991 | Goins et al. | 98/62 |
| 5,261,389 | 11/1993 | Trieb | 126/85 B |
| 5,341,767 | 8/1994 | Smith | 122/14 |
| 5,392,760 | 2/1995 | Binzer | 126/85 B |

*Primary Examiner*—Denise L. Ferensic
*Assistant Examiner*—Jiping Lu
*Attorney, Agent, or Firm*—Konneker & Smith, P.C.

[57] ABSTRACT

An outside air intake hood for receiving combustion air for delivery to a direct vent, fuel-fired heating appliance such as a water heater has an opposing pair of side inlets positionable to face parallel to an outside wall upon which the hood is mounted, an outer side wall extending between the inlets, and an outlet passage with an entry portion facing and spaced inwardly apart from the outer side wall. A generally V-shaped baffle member is positioned within the hollow body of the hood, with an apex portion of the baffle member facing the entry portion of the outlet passage. When the wind is horizontally blowing generally parallel to the outside wall, a side wall of the baffle member deflects the wind-driven outside air entering one of the hood side inlets into the outlet passage in a manner converting momentum of the entering air into pressure in a manner preventing the creation of an undesirable vacuum at the hood outlet. A bypass passage disposed within the hood outwardly of the outlet passage entry portion communicates the two side outlets and prevents undesirable wind-created overpressurization of the outlet passage. Such bypass passage representatively extends through a gap between the baffle and the entry portion of the outlet passage and may also extend through the baffle itself.

25 Claims, 3 Drawing Sheets

COMBUSTION AIR INTAKE APPARATUS FOR FUEL-FIRED, DIRECT VENT HEATING APPLIANCE

BACKGROUND OF THE INVENTION

The present invention generally relates to heating apparatus and, in a preferred embodiment thereof, more particularly relates to a specially designed outside combustion air intake hood structure for a fuel-fired, direct vent water heater.

A fuel-fired water heater is typically installed in an interior building space and, during operation of the water heater, discharges combustion gases through a vent stack to the exterior of the building while at the same time receiving outside combustion air via a suitable air inlet duct communicated with its combustion chamber. A direct vent water heater induces the requisite flow of outside combustion air through this air inlet duct by the natural draft stack effect (created by the burning of a fuel-air mixture within its combustion chamber) thereby eliminating the need for any forced draft equipment (such as a draft inducer fan) and any associated power requirement. While the use of natural combustion draft in place of, for example, a draft inducer fan to flow outside air into the water heater's combustion chamber desirably lessens the overall cost of the water heater, it often poses a design challenge relating to the prevention of undesirable fluctuations in the pressure of combustion air being delivered to the water combustion chamber.

Specifically, an air intake hood is typically mounted on the outer surface of an outside wall and connected to the combustion air inlet duct. The air intake hood is needed to protect the combustion air duct inlet from contamination while permitting sufficient air flow into the water heater combustion chamber. When the wind blows in a direction perpendicular to the duct inlet (e.g., parallel to the outside wall upon which the intake hood is mounted) at high speed, a negative pressure is created at the air duct inlet which correspondingly creates a more negative pressure in the combustion chamber which may snuff out the burner flame or at least deprive it of sufficient combustion air. Similarly, when a strong wind is blowing generally toward the outside wall upon which the intake hood is mounted, an undesirably high pressure may be created within the water heater combustion chamber.

As can be readily seen from the foregoing, a need exists for an improved combustion air intake hood structure, for a water heater or other types of fuel-fired direct vent heating appliances, in which the combustion air inlet duct pressure variations caused by changes in outside wind directions is substantially lessened. It is to this need that the present invention is directed.

SUMMARY OF THE INVENTION

In carrying out principles of the present invention, in accordance with a preferred embodiment thereof, a fuel-fired direct vent heating appliance, representatively a water heater disposed within a building, is provided with a specially designed outside air intake hood. The hood is externally mountable on an outside wall of the building and is operative to receive outside combustion air deliverable to a combustion chamber portion of the appliance via an air inlet duct interconnectable between the appliance and the intake hood. The hood is uniquely designed to prevent both wind-created overpressurization and underpressurization of the outside combustion air traversing the hood interior and flowing therefrom into the air inlet duct.

The hood, in a preferred embodiment thereof, includes a hollow body having an outer side wall extending between facing first and second inlet openings spaced apart in a first direction and through which outside combustion air may enter the interior of the hollow body, and an outlet passage through which outside combustion air may flow outwardly from the interior of the hollow body. With the hood operatively installed on the outside wall, the first and second opposite outlet openings face parallel to the external surface of the outside wall, and the outer side wall of the hood body is parallel to and spaced outwardly apart from the external surface of the outside wall. The hood outlet passage has an open entry portion facing the outer body side wall and spaced apart therefrom in a second direction transverse to the first direction.

A baffle structure is associated with the hollow body and is operative to intercept outside combustion air entering one of the first and second inlet openings in the first direction and deflect the intercepted outside combustion air into the entry portion of the hood outlet passage. This interception and deflection of the incoming outside combustion air converts its momentum into pressure, thereby preventing the undesirable creation of a vacuum at entrance to the outlet passage when the wind is blowing generally horizontally to the outside wall.

According to a key aspect of the invention, an air pressure relief bypass passage extends between the first and second inlet openings through the interior of the hollow hood body outwardly of the open entry portion of the outlet passage. This passage permits a quantity of the wind-driven air entering the hood through one of its side inlet openings to simply be forced out the opposite side inlet opening to thereby prevent undesirable wind-overpressurization of the hood interior.

The baffle structure preferably has a generally V-shaped configuration, with an apex portion that faces an entry portion of the hood outlet passage, and opposite side walls that are representatively flat but may also be concavely curved if desired. In one embodiment of the baffle structure the apex portion is spaced outwardly from the entry portion of the outlet passage to form a gap between the apex portion and the outlet passage entry portion, the gap defining a portion of the air pressure relief bypass passage. Representatively, the ratio of the width of the gap in the aforementioned first direction to the distance from the outer hood body side wall and the entry portion of the hood outlet passage is within the range of from about 0.09 to about 0.21. Alternatively, all or a portion of the pressure relief bypass passage may extend through the baffle structure outwardly of the hood outlet passage entry portion.

According to another feature of the invention, with the hood body outside wall in its installed vertical orientation, wind-created overpressurization of the hood interior when the wind is blowing generally transversely to the outside wall is prevented by positioning the entry portion of the hood outlet passage entirely within the horizontal footprint of the outer side wall. This prevents wind driven air from directly entering the hood interior in a direction transverse to the outside wall by causing the air to be diverted around an edge portion of the outer side wall.

In a preferred embodiment of the hood, the inner side of the hood body is defined by a rectangular frame structure having an inset portion with an inner side wall through which an outlet opening is formed. This inset portion defines the entry portion of the hood outlet passage. Preferably, a screen member is suitably secured to the inner side wall over its outlet opening to prevent debris from entering the air inlet duct connected to the hood outlet passage.

DETAILED DESCRIPTION

Figure 1:
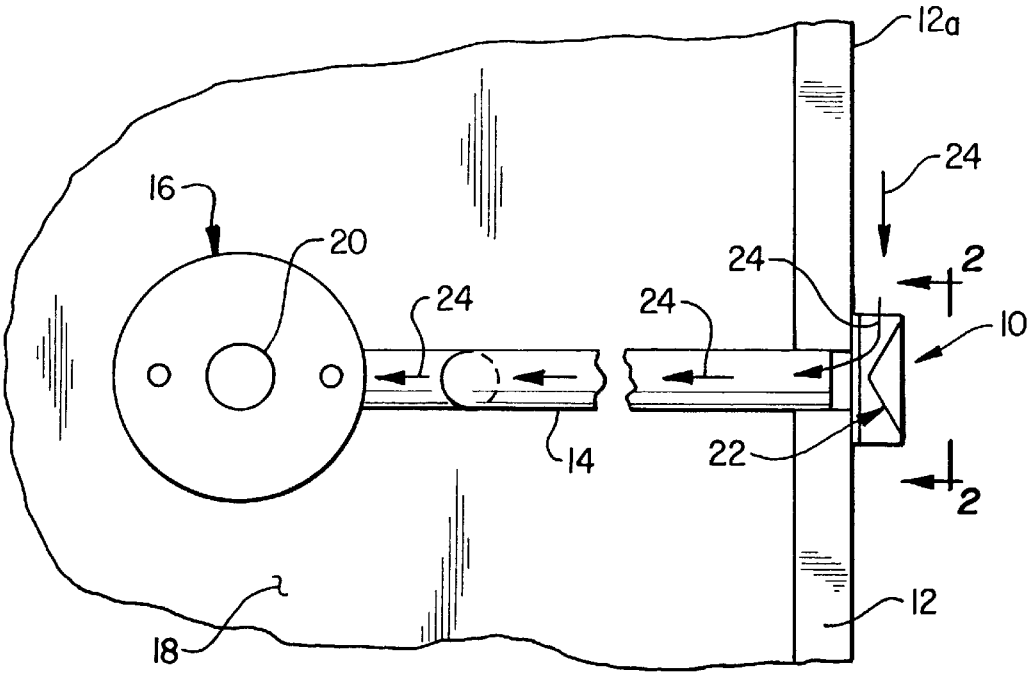
FIG. 1 is a schematic top plan view of a representative fuel-fired, direct vent water heater operatively connected to a specially designed outside combustion air intake hood structure embodying principles of the present invention.

Schematically illustrated in FIG. 1 is a specially designed outside combustion air intake hood 10 that embodies principles of the present invention and is externally mounted on the outside wall 12 of a building. The hood 10 is connected to an air intake duct 14 to flow outside combustion air therethrough to a fuel-fired direct vent water heater 16 (or other type of fuel-fired direct vent heating appliance such as a boiler or furnace) located within an interior building space 18. The water heater 16 discharges hot combustion products via a flue structure 20 exiting the building at a point (not shown) remote from the air intake hood 10.

As subsequently described herein in greater detail, the hood 10 is provided with a specially configured internal baffle member 22 that substantially eliminates the presence of negative pressure in the water heater combustion chamber when the wind blows generally parallel to the exterior surface 12*a* of the outside wall 12 such that the incoming outside combustion air 24 flows horizontally into an open vertical side of the hood 10 facing parallel to the external surface 12*a* of the outside wall 12. As will be seen, the hood 10 operates to substantially eliminate the undesirable presence of a negative pressure in the combustion chamber when the wind blows near the zero degree angle (i.e., parallel to the external surface 12*a* of the outside wall 12), while at the same time preserving combustion and preventing wind-created overpressurization of the water heater combustion chamber when the wind blows at all other angles.

Turning now to FIGS. 2–5, in addition to the internal baffle member 22, the combustion air intake hood 10 includes a generally U-shaped outer body panel 26, a rectangular screen member 28, and a rectangular inner side frame structure 30. These components 22,26,28 and 30 of the overall intake hood structure 10 are representatively formed from a sheet metal material, but could alternatively formed from another suitably rigid and durable sheet material, such as plastic, if desired.

The outer body panel 26 has an outer side wall portion 32 with opposite upper and lower wall portions 34,36 projecting transversely from opposite side edges thereof. The internal baffle member 22 is nestable within the outer body panel 26 and has a generally V-shaped central portion defined by mutually angled opposite side portions 38,40 joined at a rounded apex portion 42 at inner side edges thereof and having parallel, outwardly directed connection flange portions 44 at their outer edges.

Inner side frame 30 has a rectangular peripheral portion 46 with an outer side 46*a*, side sections 48,50,52 and 54, and an inset area 56 having an open outer side and being bounded at an inner side thereof by a rectangular inner side wall 58 having a central circular opening 60 formed therein. Connected to the inner side wall 58 at its opening 60, and extending away from the inset area 56, is a circularly cross-sectioned connection stub duct 14*a* which is connectable to the inlet end of the previously mentioned combustion air intake duct 14.

With continuing reference to FIGS. 2–5, in fabricating the combustion air intake hood 10, the internal baffle member 22 is nested within the outer body panel 26, with the baffle apex 42 spaced inwardly apart from the inner side of the outer side wall 32 of the body panel 26, and the connection flange portions 44 of the baffle member 22 are secured to the panel wall 32 using suitable screws 62 (see FIG. 4) extended through aligned openings 64,66 (see FIG. 5) formed in the panel wall 32 and the baffle member connection flanges 44. Using suitable fasteners (not shown) the screen 28 is secured to the outer side of the frame wall 58 over the circular opening 60 therein.

Figure 4:
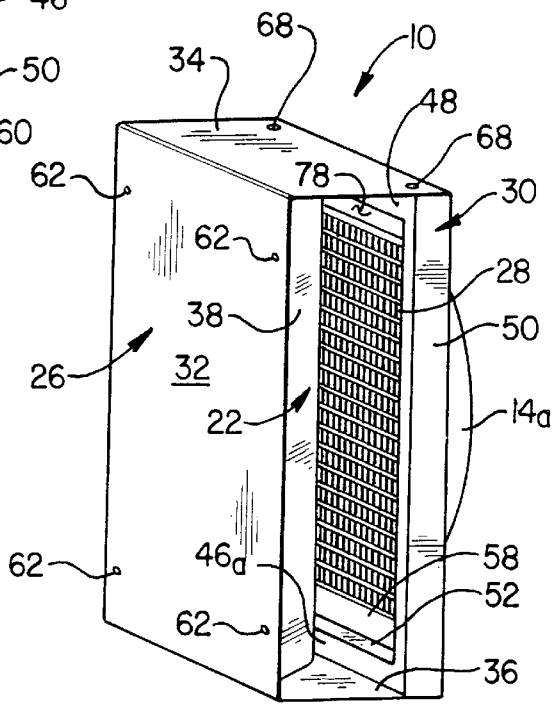
FIG. 4 is a perspective view of the air intake hood structure in an assembled state.
Figure 5:
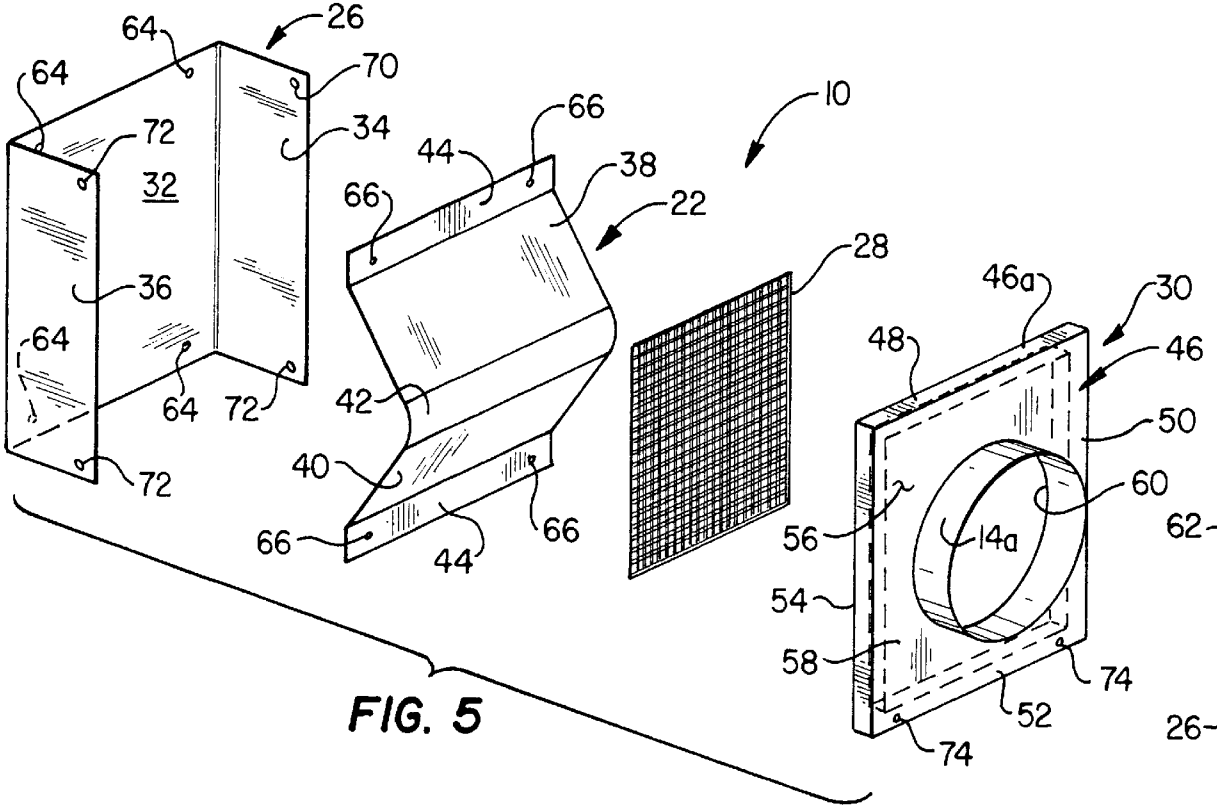
FIG. 5 is an exploded perspective view of air intake hood structure.

The upper and lower panel walls 34,36 are then respectively placed outwardly over the frame sides 48,52 and secured thereto using suitable screws 68 (see FIG. 4) extended through aligned openings 70,72 in the panel wall portions 34,36 and the frame sides 48,52 (see FIG. 5). The completed combustion air intake hood 10 is then suitably secured to the external side 12*a* of the outside wall 12 (see FIG. 3), with the stub duct portion 14*a* of the hood 10 extending inwardly through a circularly cross-sectioned opening 74 in the outside wall 12 (see FIG. 3) and operatively connected to an outer end portion of the combustion air intake duct 14.

Figure 2:
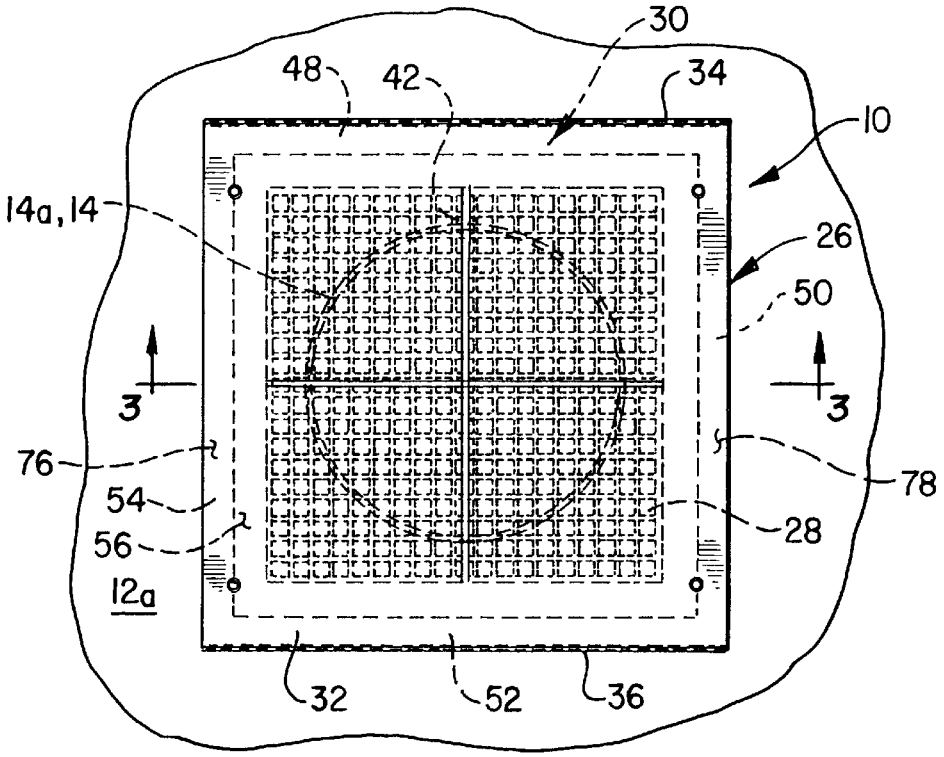
FIG. 2 is an enlarged scale outer side elevational view of the air intake hood structure taken along line 2—2 of FIG. 1.
Figure 3:
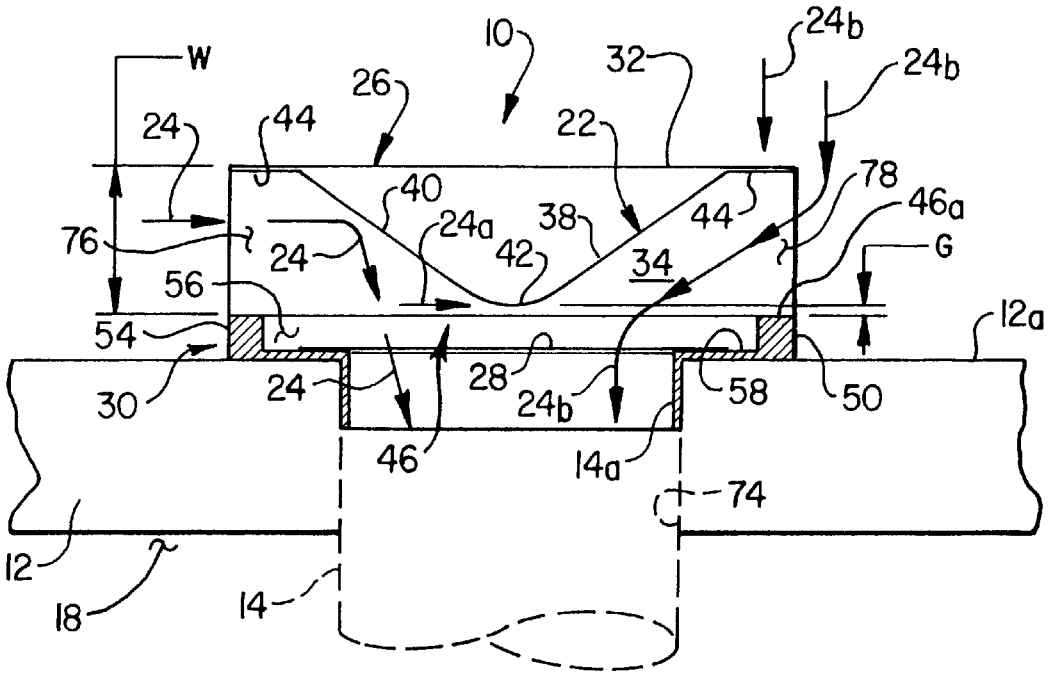
FIG. 3 is a simplified, somewhat schematic cross-sectional view through the air intake hood structure taken along line 3—3 of FIG. 2.

As can best be seen in FIGS. 2–4, with the combustion air intake hood 10 operatively installed on the outside wall 12, the hood 10 has horizontally opposite outer side openings 76,78 disposed at its periphery and communicated with the frame inset area 56. Additionally, as best illustrated in FIG. 2, the frame inset area 56 is disposed entirely within the horizontal footprint area of the outer side wall portion 32 of the outer body panel 26 which is spaced horizontally outwardly from the frame portion 46 in a direction transverse to the external surface 12*a* of the outside wall 12. The recessed frame area defines with the interior of the stub duct 14*a* an outlet passage 56,14*a* through which combustion air entering the interior of the hood 10 may exit the hood for delivery to the water heater 16 (or other fuel fired, direct vent heating appliance as the case may be).

During firing of the water heater 16, with the wind representatively blowing from the left and generally parallel to the external surface 12*a* of the outside wall 12 as viewed in FIG. 3, the outside combustion air 24 is wind-driven inwardly through the outer side opening 76 of the hood 10. In conventional types of air intake hood structures as previously described herein this combustion air 24 would, for the most part simply exit through the opposite hood side opening 78 and undesirably create a negative pressure at the inlet of the air intake duct 14, thereby correspondingly reducing the combustion chamber pressure within the water heater 16.

In the specially designed hood 10 of the present invention, however, the wind-driven incoming outside combustion air 24 is intercepted by the sloping side wall portion 40 of the internal baffle member 22 and deflected into the hood outlet passage 56,14*a* for delivery from the hood 10 to the combustion chamber of the water heater 16 via the air inlet duct 14. By deflecting the wind-driven incoming combustion air 24 in this manner, the hood 10 converts at least a portion of the momentum of the incoming combustion air 24 to static pressure, thereby preventing the undesirable creation of partial vacuum condition at the inlet to the duct 14 and a corresponding adverse effect on the combustion chamber pressure.

According to a key aspect of the present invention, an undesirable overpressurization of the combustion air entering the hood outlet passage, due to this momentum-to-pressure conversion, is avoided by the provision of a pressure relief bypass passage extending between the hood inlets 76,78 and positioned outwardly of the outlet passage 56,14*a*—i.e., between (1) the open entry end portion of the passage 56,14*a* defined by the frame inset area 56 and (2) the outer side wall portion 32 of the hood 10. Representatively, this pressure relief bypass passage is defined by a gap G (see FIG. 3) positioned between the open outer side of the frame inset area 56 and the baffle apex portion 42. Due to the presence of this gap G, a portion 24*a* of the wind-driven incoming combustion air 24 is permitted to bypass the outlet passage 56,14*a* and simply flow outwardly through the hood inlet opening 78, thereby limiting the air pressure buildup at the entrance to the outlet passage 56,14*a* during operation of the water heater 16.

As will be appreciated, the hood 10 functions in an identical but opposite manner when the wind is blowing from the right and parallel to the external surface 12*a* of the outside wall 12 as viewed in FIG. 3. While the thickness of the gap G relative to the width W of the hood 10 from its outer side wall to the entrance to the outlet passage 56,14*a* may be varied to suit design conditions, the ratio G/W representatively shown in FIG. 3 is in the approximate range of from about 0.09 to about 0.21.

As previously mentioned herein, the open outer side of the frame recess area 56, which defines an inlet portion of the air outlet passage 56,14*a,* is disposed entirely within the horizontal footprint of the outer side wall portion 32 of the hood 10. Accordingly, when combustion air 24*b* (see FIG. 3) is being wind-driven directly toward the external surface 12*a* of the exterior wall 12, the outer side wall 32 acts as a deflection baffle to prevent the wind-driven combustion air 24*b* from being forced directly into the interior of the hood 10 and the outlet passage 56,14*a* and thereby overpressurizing the entrance of the air inlet duct 14. Instead, as illustrated at a right outer corner of the hood 10 as viewed in FIG. 3, the incoming wind-driven combustion air 24*b* is forced to curve around a vertical side edge of the outer side wall 32 at the hood opening 78, thereby substantially reducing the combustion air inlet pressure within the hood 10.

Figure 6:
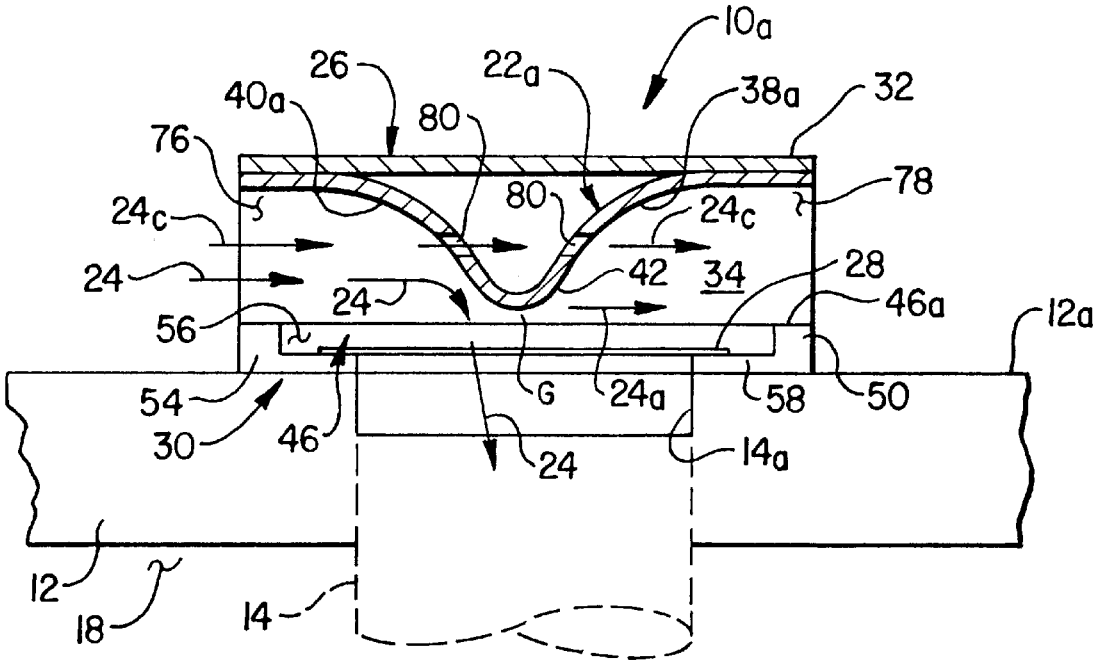
FIG. 6 is an upwardly directed simplified cross-sectional view through an alternate embodiment of the air intake hood structure.

Cross-sectionally illustrated in simplified form in FIG. 6 is an alternate embodiment of the previously described outside combustion air intake hood 10. As shown in the previously described hood 10, the oppositely sloping side walls 38,40 of the internal baffle member 22 have an essentially straight configuration. However, the corresponding opposite side walls 38*a*,40*a* of the internal baffle member 22*a* have, as viewed from the opposite hood inlet openings 76 and 78, concave curvatures. This concavity of the baffle member side walls 38*a*,40*a* serve to increase the momentum-to-pressure conversion magnitude achieved by the interception of wind-driven combustion air 24*c* flowing to the right as viewed in FIG. 6.

Additionally, the pressure relief bypass passage defined by the gap G is representatively augmented by a second pressure relief bypass passage extending between the hood inlet openings 76,78 via communicated openings 80 formed through the baffle side walls 38*a*,40*a*. As illustrated in FIG. 6, a first portion 24*a* of the wind-driven rightly moving outside combustion air 24 bypasses the hood outlet passage 56,14*a* via the gap G, while a second portion 24*c* of the combustion air 24 bypasses the hood outlet passage 56,14*a* via baffle openings 80. As an alternative to using these two pressure relief bypass passages, the gap G could be eliminated leaving a single bypass passage extending through the baffle side wall openings 80. As another bypass alternative, a pressure relief bypass passage (not shown) could be positioned between the baffle member 22*a* (or the baffle 22) and the outer hood side wall 32 and used by itself or in combination with either or both of the gap G and the baffle side wall holes 80.

The foregoing detailed description is to be clearly understood as being given by way of illustration and example, the spirit and scope of the present invention being limited solely by the appended claims.

What is claimed is:

1. An outside air intake hood for receiving combustion air deliverable to a fuel-fired heating appliance, comprising:

a hollow body having an outer side wall extending between facing first and second inlet openings spaced apart in a first direction and through which outside combustion air may enter the interior of said hollow body, and an outlet passage through which outside combustion air may flow outwardly from the interior of said hollow body, said outlet passage having an open entry portion facing said outer side wall and spaced apart therefrom in a second direction transverse to said first direction;

a baffle structure associated with said hollow body and being operative to intercept outside combustion air entering one of said first and second inlet openings in said first direction and deflect the intercepted outside combustion air into said entry portion of said outlet passage; and an air pressure relief bypass passage extending between said first and second inlet openings through the interior of said hollow body outwardly of said open entry portion of said outlet passage, said air pressure relief passage being operative to permit a portion of wind-driven outside combustion air entering one of said first and second inlet openings in said first direction to flow through said pressure relief passage, and be discharged through the other of said first and second inlet openings, without flowing into said open entry portion of said outlet passage.

2. The outside air intake hood of claim 1 wherein:

said open entry portion of said outlet passage, when said outer side wall is vertically oriented, is disposed entirely within the horizontal footprint of said outer side wall.

3. The outside air intake hood of claim 1 wherein:

said hollow body has a frame portion spaced apart from said outer side wall in said first direction and having an inset area defining said open entry portion of said outlet passage.

4. The outside air intake hood of claim 3 wherein:

said inset area has an inner side wall portion with an outlet opening therein, and said outside air intake hood further comprises a screen member supported within said inset area and extending across said outlet opening in said inner side wall portion.

5. The outside air intake hood of claim 1 wherein:

said baffle structure has a generally V-shaped configuration with an apex portion facing said open entry portion of said outlet passage.

6. The outside air intake hood of claim 5 wherein:

said baffle structure has first and second substantially straight side walls diverging outwardly from said apex portion.

7. The outside air intake hood of claim 5 wherein:

said baffle structure has first and second concavely curved side walls diverging outwardly from said apex portion.

8. The outside air intake hood of claim 5 wherein:

said apex portion is spaced outwardly from said open entry portion in a manner such that a gap is formed therebetween, said air pressure relief passage extending through said gap.

9. The outside air intake hood of claim 8 wherein:

said gap has a width in said first direction, said open entry portion is spaced apart a distance in said first direction from said outer side wall, and the ratio of said width to said distance is in the range of from about 0.09 to about 0.21.

10. The outside air intake hood of claim 1 wherein:

said baffle structure extends from said outer side wall toward said open entry portion, with a gap being disposed between said baffle structure and said open entry portion, said air pressure relief bypass passage extending through said gap.

11. The outside air intake hood of claim 5 wherein:

said air pressure relief bypass passage extends through said baffle structure in said first direction.

12. The outside air intake hood of claim 1 wherein:

said air pressure relief bypass passage extends through said baffle structure in said first direction.

13. Heating apparatus comprising:

a fuel-fired heating appliance adapted to receive combustion air from a source thereof;

an outside air intake hood for receiving combustion air deliverable to said fuel-fired heating appliance, said outside air intake hood being externally mountable on an outside wall of a building and including:

a hollow body having an outer side wall extending between facing first and second inlet openings spaced apart in a first direction and through which outside combustion air may enter the interior of said hollow body, and an outlet passage through which outside combustion air may flow outwardly from the interior of said hollow body, said outlet passage having an open entry portion facing said outer side wall and spaced apart therefrom in a second direction transverse to said first direction, a baffle structure associated with said hollow body and being operative to intercept outside combustion air entering one of said first and second inlet openings in said first direction and deflect the intercepted outside combustion air into said entry portion of said outlet passage, and an air pressure relief bypass passage extending between said first and second inlet openings through the interior of said hollow body outwardly of said open entry portion of said outlet passage, said air pressure relief passage being operative to permit a portion of wind-driven outside combustion air entering one of said first and second inlet openings in said first direction to flow through said pressure relief passage, and be discharged through the other of said first and second inlet openings, without flowing into said open entry portion of said outlet passage; and a combustion air inlet duct interconnectable between said fuel-fired heating appliance and said outlet passage and operative to flow combustion air from said outside air intake hood to said fuel-fired heating appliance.

14. The heating apparatus of claim 13 wherein:

said fuel-fired heating appliance is a water heater.

15. The heating apparatus of claim 13 wherein:

said open entry portion of said outlet passage, when said outer side wall is vertically oriented, is disposed entirely within the horizontal footprint of said outer side wall.

16. The heating apparatus of claim 13 wherein:

said hollow body has a frame portion spaced apart from said outer side wall in said first direction and having an inset area defining said open entry portion of said outlet passage.

17. The heating apparatus of claim 16 wherein:

said inset area has an inner side wall portion with an outlet opening therein, and said outside air intake hood further comprises a screen member supported within said inset area and extending across said outlet opening in said inner side wall portion.

18. The heating apparatus of claim 13 wherein:

said baffle structure has a generally V-shaped configuration with an apex portion facing said open entry portion of said outlet passage.

19. The heating apparatus of claim 18 wherein:

said baffle structure has first and second substantially straight side walls diverging outwardly from said apex portion.

20. The heating apparatus of claim 18 wherein:

said baffle structure has first and second concavely curved side walls diverging outwardly from said apex portion.

21. The heating apparatus of claim 18 wherein:

said apex portion is spaced outwardly from said open entry portion in a manner such that a gap is formed therebetween, said air pressure relief passage extending through said gap.

22. The heating apparatus of claim 21 wherein:

said gap has a width in said first direction, said open entry portion is spaced apart a distance in said first direction from said outer side wall, and the ratio of said width to said distance is in the range of from about 0.09 to about 0.21.

23. The heating apparatus of claim 13 wherein:

said baffle structure extends from said outer side wall toward said open entry portion, with a gap being disposed between said baffle structure and said open entry portion, said air pressure relief bypass passage extending through said gap.

24. The heating apparatus of claim 18 wherein:

said air pressure relief bypass passage extends through said baffle structure in said first direction.

25. The heating apparatus of claim 13 wherein:

said air pressure relief bypass passage extends through said baffle structure in said first direction.

* * * * *

UNITED STATES PATENT AND TRADEMARK OFFICE

CERTIFICATE OF CORRECTION

PATENT NO. : 6,125,839
DATED : October 3, 2000
INVENTOR(S) : Amgad A. Elgowainy and John H. Scanlon It is certified that error appears in the above-identified patent and that said Letters Patent is hereby corrected as shown below:

Column 6,
Line 60, change “first” to -- second --.

Column 7,
Lines 18 and 20, change “first” to -- second --.

Column 8,
Lines 19, 46 and 48, change “first” to -- second --.

Signed and Sealed this

Sixteenth Day of September, 2003

JAMES E. ROGAN
*Director of the United States Patent and Trademark Office*